US008299408B2

(12) United States Patent
Kimrey, Jr.

(10) Patent No.: US 8,299,408 B2
(45) **Date of Patent: *Oct. 30, 2012**

(54) MICROWAVE REACTOR HAVING A SLOTTED ARRAY WAVEGUIDE COUPLED TO A WAVEGUIDE BEND

(75) Inventor: Harold D. Kimrey, Jr., Knoxville, TN (US)

(73) Assignee: Eastman Chemical Company, Kingsport, TN (US)

( * ) Notice: Subject to any disclaimer, the term of this patent is extended or adjusted under 35 U.S.C. 154(b) by 1167 days.

This patent is subject to a terminal disclaimer.

(21) Appl. No.: 11/524,261

(22) Filed: Sep. 21, 2006

(65) Prior Publication Data

US 2007/0079523 A1 Apr. 12, 2007

Related U.S. Application Data

(60) Provisional application No. 60/719,180, filed on Sep. 22, 2005.

(51) Int. Cl.
*H05B 6/68* (2006.01)
*H05B 6/70* (2006.01)
*F26B 21/06* (2006.01)

(52) U.S. Cl. ..... 219/690; 219/693; 34/79

(58) Field of Classification Search ..... 219/690, 219/691, 693, 694, 695, 707, 746, 750; 118/500, 118/723 ME, 723 MR; 34/79, 412, 259, 34/265, 264

See application file for complete search history.

(56) References Cited

U.S. PATENT DOCUMENTS 2,820,127 A 1/1958 Argento et al.
2,909,635 A 10/1959 Haagensen
3,263,052 A * 7/1966 Jeppson et al. ..... 219/700
3,328,800 A * 6/1967 Algeo ..... 343/768
3,446,929 A 5/1969 Smith
3,848,106 A 11/1974 Berggren et al.
3,916,137 A 10/1975 Jurgensen
4,027,133 A 5/1977 Dygve et al.
4,247,858 A 1/1981 Eichweber
4,626,640 A 12/1986 van der Heijden
4,728,910 A 3/1988 Owens
4,771,153 A 9/1988 Fukushima et al.
4,777,336 A 10/1988 Asmussen (Continued)

FOREIGN PATENT DOCUMENTS

DE 4008770 A1 9/1991

(Continued)

OTHER PUBLICATIONS

International Search Report for PCT/US2006/036799 dated Sep. 21, 2006 (8 pages).

(Continued)

*Primary Examiner* — Quang Van
(74) *Attorney, Agent, or Firm* — William K. McGreevey

(57) ABSTRACT

A system for heating wood products is provided. The system may include a launcher. The launcher may include a waveguide bend and a waveguide. The launcher may have one or more slots along the longitudinal axis of the waveguide. The slots may be slanted at an angle with respect to the longitudinal axis and spaced at an interval along the longitudinal axis. Moreover, the system may include windows covering the slots. The windows may serve as a physical barrier and allow electromagnetic energy to be transferred from the launcher to the wood product. The launcher and wood products may be contained in a microwave reactor (also referred to as a chamber) to heat the wood products.

24 Claims, 6 Drawing Sheets

U.S. PATENT DOCUMENTS

| | | | | |
|---|---|---|---|---|
| 4,851,788 | A | 7/1989 | Ives et al. | |
| 5,075,131 | A | 12/1991 | Hattori et al. | |
| 5,107,602 | A | 4/1992 | Lööf | |
| 5,541,612 | A | 7/1996 | Josefsson | |
| 5,610,567 | A | 3/1997 | Phillips et al. | |
| 5,638,079 | A | 6/1997 | Kastner et al. | |
| 5,714,920 | A | 2/1998 | Ivanov et al. | |
| 5,834,744 | A | 11/1998 | Risman | |
| 5,834,746 | A | 11/1998 | Pedersen et al. | |
| 5,843,236 | A | 12/1998 | Yoshiki et al. | |
| 5,869,817 | A | 2/1999 | Zietlow et al. | |
| 5,970,624 | A | 10/1999 | Moriya | |
| 6,072,167 | A | 6/2000 | Lewis et al. | |
| 6,081,241 | A | 6/2000 | Josefsson et al. | |
| 6,121,595 | A | 9/2000 | Lewis et al. | |
| 6,204,606 | B1 | 3/2001 | Spence et al. | |
| 6,246,039 | B1 | 6/2001 | Omori et al. | |
| 6,333,496 | B1 | 12/2001 | Risman et al. | |
| 6,546,646 | B1 | 4/2003 | Thomas | |
| 6,675,495 | B2 | 1/2004 | Dedieu et al. | |
| 6,797,929 | B2 | 9/2004 | Drozd et al. | |
| 6,833,537 | B2 | 12/2004 | Risman et al. | |
| 6,870,123 | B2 | 3/2005 | Suzuki et al. | |
| 6,903,557 | B2 | 6/2005 | Holmes et al. | |
| 6,933,482 | B2 | 8/2005 | Fagrell et al. | |
| 7,122,772 | B2 | 10/2006 | Feher et al. | |
| 7,256,665 | B2 | 8/2007 | Harris | |
| 7,300,705 | B2 | 11/2007 | Neogi et al. | |
| 7,518,092 | B2 | 4/2009 | Purta et al. | |
| 7,666,235 | B2 | 2/2010 | Learey et al. | |
| 7,846,295 | B1 | 12/2010 | Medoff | |
| 2004/0008943 | A1 | 1/2004 | Berini | |
| 2007/0079522 | A1 * | 4/2007 | Kimrey | 34/79 |
| 2010/0000110 | A1 | 1/2010 | Li | |
| 2010/0331531 | A1 | 12/2010 | Mykytka | |
| 2011/0091736 | A1 | 4/2011 | Felty, Jr. et al. | |

FOREIGN PATENT DOCUMENTS

| | | | |
|---|---|---|---|
| GB | 2 071 833 | A | 9/1981 |
| JP | 1222060 | A | 9/1989 |
| RU | 2057404 | | 3/1996 |
| RU | 2 133 933 | C1 | 7/1999 |
| WO | WO 98/01497 | | 1/1998 |
| WO | 2009/095687 | A1 | 8/2009 |
| WO | 2011/090448 | A1 | 7/2011 |

OTHER PUBLICATIONS

International Search Report for PCT/US2006/036798 dated May 28, 2008.

Office Action date of mailing Sep. 18, 2009 received in U.S. Appl. No. 11/524,239.

Office Action date of mailing May 28, 2010 received in U.S. Appl. No. 11/524,239.

Office Action date of mailing Dec. 1, 2010 received in U.S. Appl. No. 11/524,239.

Leonelli, Cristina and Mason, Timothy J.; "Chemical Engineering and Processing: Process Intensification", Chemical Engineering and Processing, 49 (2010) pp. 885-900.

Brelid, P. Larsson; Simonson, R. and Risman, P. O.; "Acetylation of Solid Wood Using Microwave Heating, Part 1. Studies of Dielectric Properties"; Holz als Roh und Werkstoff; 57, pp. 259-263; (1999).

Brelid, P. Larsson and Simonson, R.; "Acetylation of Solid Wood Using Microwave Heating, Part 2. Experiments in Laboratory Scale"; Holz als Roh—und Werkstoff; 57, pp. 383-389; (1999).

Daian, M.; Doctoral Thesis: "The Development and Evaluation of New Microwave Equipment and its Suitability for Wood Modification"; Industrial Research Institute Swinburne; Swinburne University of Technology; 2006 retrieved online at researchbank.swinburne.edu.au.

Hansson, L.; Doctoral Thesis: "Microwave Treatment of Wood"; Lulea University of Technology (LTU), Division of Wood Physics, 2007.

* cited by examiner

MICROWAVE REACTOR HAVING A SLOTTED ARRAY WAVEGUIDE COUPLED TO A WAVEGUIDE BEND

CROSS REFERENCE TO RELATED APPLICATION

This application claims the benefit of U.S. Provisional Patent Application Ser. No. 60/719,180 entitled "MICROWAVE REACTOR HAVING A SLOTTED ARRAY WAVEGUIDE COUPLED TO A WAVEGUIDE BEND" filed Sep. 22, 2005, the entire disclosure of which is expressly incorporated herein.

TECHNICAL FIELD

The present invention generally relates to a microwave reactor and, more particularly, to a microwave reactor having a slotted array waveguide coupled to a waveguide bend.

BACKGROUND

Wood is used in many applications that expose the wood to decay, fungi, or insects. To protect the wood, one alternative is to use traditional wood impregnation approaches, such as pressure treatment chemicals and processes. An alternative approach is to chemically modify the wood by reacting the wood with acetic anhydride and/or acetic acid. This type of modification is referred to as acetylation. Acetylation makes wood more resistant to decay, fungi, and insects.

Acetylation may be performed by first evacuating and then soaking the wood product in acetic anhydride, then heating it with optional pressure to cause a chemical reaction. Ideally, acetylation of wood products, such as planks, studs, and deck materials, would allow for large amounts of wood to be rapidly impregnated with the acetic anhydride. As such, any heating of wood products during acetylation would also ideally accommodate large quantities of wood products (e.g., bundles of boards). It would also be desirable to heat the wood products during acetylation evenly throughout the wood—thereby providing uniform modification of the wood and minimizing any damage to the wood caused by overheating due to hot spot formation. Thus, there is a need for improved mechanisms for heating wood products to facilitate acetylation.

SUMMARY

Systems and methods consistent with the present invention provide a microwave reactor having a slotted array waveguide coupled to a waveguide bend for heating materials. Moreover, the systems and methods may provide heat for materials during a chemical process, such as acetylation.

In one exemplary embodiment, there is provided a system for heating a wood product. The system includes a launcher, wherein the launcher includes a waveguide bend and a waveguide. The launcher may have one or more slots along a longitudinal axis of the waveguide. The slots may be slanted at an angle with respect to the longitudinal axis and spaced at an interval along the longitudinal axis. Moreover, a window may cover each of the slots. The window may serve as a barrier and allow electromagnetic energy to be transferred from the launcher to the wood product.

It is to be understood that both the foregoing general description and the following detailed description are exemplary and explanatory only and are not restrictive of the invention, as described. Further features and/or variations may be provided in addition to those set forth herein. For example, the present invention may be directed to various combinations and subcombinations of the disclosed features and/or combinations and subcombinations of several further features disclosed below in the detailed description.

DESCRIPTION OF THE DRAWINGS

The accompanying drawings, which constitute a part of this specification, illustrate various embodiments and aspects of the present invention and, together with the description, explain the principles of the invention. In the drawings.

DETAILED DESCRIPTION

Figure 1:
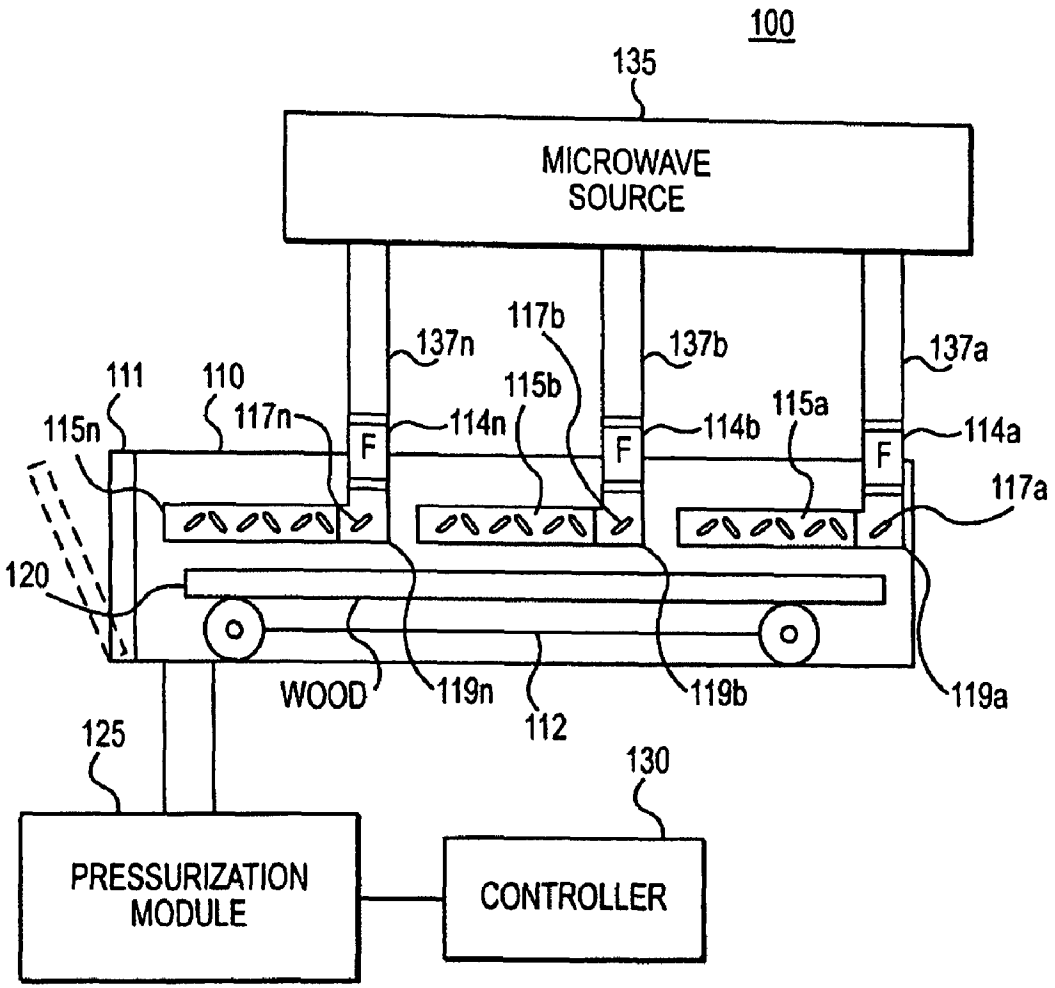
FIG. 1 illustrates, in block diagram form, an example of a microwave reactor having slotted array waveguides coupled to waveguide bends consistent with certain aspects related to the present invention.

Reference will now be made in detail to the invention, examples of which are illustrated in the accompanying drawings. The implementations set forth in the following description do not represent all implementations consistent with the claimed invention. Instead, they are merely some examples consistent with certain aspects related to the invention. Wherever possible, the same reference numbers will be used throughout the drawings to refer to the same or like parts.

In one embodiment consistent with certain aspects of the present invention, energy from a slotted array waveguide, coupled to a waveguide bend, may be used as a source of heat. A slotted array waveguide is a waveguide with a plurality of slots. The slots serve as an opening for transmission of electromagnetic energy, such as microwave energy. A waveguide bend provides an angular transition, like an elbow. For example, a waveguide bend may provide a 90-degree transition between a chamber and the slotted array waveguide. The waveguide bend may also include one or more slots to transmit energy for heating. The use of a waveguide bend coupled to the slotted array waveguide may provide better positioning of the slots with respect to the material being heated in the chamber. Moreover, the use of waveguide bends may facilitate configuring the chamber with a plurality of waveguides—thus allowing a larger percentage of the chamber to be filled with the material being heated. In some embodiments, the slotted array waveguides coupled to waveguide bends provide heat for a chemical process, such as acetylation of a wood product.

Microwave energy from a waveguide bend and a coupled slotted array waveguide may be used as a source of heat for the modification of a wood product by acetic anhydride. To acetylate wood, in one embodiment, the wood product is first placed in a chamber (also known as a reactor). The chamber is coupled to one or more waveguide bends and associated slotted array waveguides. The use of a waveguide bend coupled to the slotted array waveguide may provide better positioning within the chamber to facilitate even heating of the wood product—enhancing acetylation and avoiding damage to the wood caused by overheating.

The acetylation process of the wood may first include pulling a vacuum on a chamber to remove air from the wood, filling the chamber with acetic anhydride, and then applying pressure to impregnate the wood product with the acetic anhydride. Next, the chamber may be drained of the excess liquid. The chamber containing the wood product may then be repressurized and heated using the slotted array waveguide. A heating phase may heat the wood product to a temperature range of, for example, about 80 degrees Celsius to about 170 degrees Celsius. The heating phase may be for a time period of, for example, about 2 minutes to about 1 hour. During the heating phase, a chemical reaction occurs in the wood product that converts hydroxyl groups in the wood to acetyl groups. By-products of this chemical reaction include water and acetic acid. When the heating phase is complete, the chamber may be put under a partial pressure and heated to remove any unreacted acetic anhydride and by-products. Although the above described an example of an acetylation process, other chemical processes may be used.

An example of a system for heating is depicted at FIG. 1. As shown, system 100 includes a pressurized chamber 110. Pressurized chamber 110 contains flanges (labeled "F") 114*a-n*, each of which is coupled to waveguide bends 119*a-n*. Waveguide bends 119*a-n* are each coupled to one of the slotted array waveguides 115*a-n*. Slotted array waveguides 115 and waveguide bends 119 have slots 117*a-n* along a longitudinal axis. The combination of a slotted array waveguide and a waveguide bend is also referred to as a launcher. Chamber 110 further contains a material 120, such as a wood product, and a carrier 112. Each of flanges 114*a-n* is coupled to one of a plurality of coupling waveguides 137*a-n*, which further couples to microwave source 135. Microwave source 135 provides electromagnetic energy to slotted array waveguides 115*a-n* and waveguide bend 119*a-n*. A controller 130 is used to control microwave source 135 and to control a pressurization module 125, which pressurizes chamber 110.

The following description refers to material 120 as a wood product 120, although other materials may be heated by system 100. Wood product 120 may be placed on carrier 112 and then inserted into chamber 110 through a chamber door 111. When chamber door 111 is sealed shut, chamber 110 may be evacuated and then filled with a chemical, such as an acetic anhydride and/or acetic acid, for treating the wood product 120. Pressurized chamber 110 is a reactor that can be pressurized to about 30-150 pounds per square inch to facilitate the impregnation rate of wood product 120. Although chamber 110 is described as a pressurized chamber, in some applications, chamber 110 may not be pressurized. Moreover, processes other than acetylation may be used to treat the wood.

Controller 130 may initiate heating by controlling microwave source 135 to provide energy for heating. Microwave source 135 provides energy to waveguide bends 119*a-n* and slotted array waveguides 115*a-n* through coupling waveguides 137*a-n* and flanges 114*a-n*. After chamber 110 is filled with a chemical, such as acetic anhydride, and then drained, controller 130 may heat wood product 120 to one or more predetermined temperatures. Moreover, controller 130 may also control the time associated with the heating of wood product 120. For example, controller 130 may control microwave source 135 to provide energy to waveguide bends 119*a-n* and slotted array waveguides 115*a-n*, such that the temperature of wood product 120 is held above about 90 degrees Celsius for about 30 minutes. After wood product 120 has been heated to an appropriate temperature and acetylation of wood product 120 is sufficient, any remaining chemicals, such as acetic anhydride, may be drained from chamber 110. Next, waveguide bends 119*a-n* and slotted array waveguides 115*a-n* may also dry wood product 120 of any excess chemicals, such as acetic anhydride, and any by-products of the chemical process. Vacuum-assisted drying may also be used to dry wood product 120. In one embodiment, chamber 110 has a diameter of 10 inches and a length of 120 inches, although other size chambers may be used.

Carrier 112 is a device for holding materials being heated by system 100. For example, carrier 112 may include a platform and wheels to carry wood product 120 into chamber 110. Carrier 112 may also be coated in a material that is resistant and non-reactive to the chemical processes occurring within chamber 110. For example, carrier 112 may be coated in a material such as Teflon™, although other materials may be used to coat carrier 112. Moreover, although carrier 112 is depicted as carrying a single wood product 120, carrier 112 may carry a plurality of wood products.

Wood product 120 may be an object comprising wood. For example, wood product 120 may include products made of any type of wood, such as hardwood species or softwood species. Examples of softwoods include pines, such as loblolly, slash, shortleaf, longleaf, or radiata pine; cedar; hemlock; larch; spruce; fir; and yew; although other types of softwoods may be used. Examples of hardwoods include beech, maple, hickory, oak, ash, aspen, walnut, pecan, cherry, teak, mahogany, chestnut, birch, larch, hazelnut, willow, poplar, elm, eucalyptus, and tupelo, although other types of hardwoods may be used. In some applications involving acetylation of wood, wood product 120 may include, for example, loblolly, slash, shortleaf, longleaf, or radiata pine. Wood products 120 may have a variety of sizes and shapes including, for example, sizes and shapes useable as timbers, lumber, deckboards, veneer, plies, siding boards, flooring, shingles, shakes, strands, sawdust, chips, shavings, wood flour, fibers, and the like.

Waveguide bends 119*a-n* and slotted array waveguides 115*a-n* each include slots 117*a-n* along the longitudinal axis of the waveguide, although under some circumstances waveguide bends 119 may not include slots. The slots are cut into the walls of waveguides 115 and waveguide bends 119 to allow electromagnetic energy, such as microwaves, to be transmitted from a slot to the material being heated (e.g., wood product 120). FIG. 1 depicts slots 117 as having a somewhat rectangular shape with rounded ends. However, in certain applications the slots may have other shapes that facilitate transmission of electromagnetic energy from slots 117 to the material being heated.

Slotted array waveguides 115 may be implemented as metal structures for channeling electromagnetic energy. Slotted array waveguides 115 may comprise any appropriate metal, such as stainless steel, copper, aluminum, or beryllium copper. Although FIG. 1 depicts slotted array waveguides 115 as rectangular waveguides, the cross sections of slotted array waveguides 115 may have other shapes (e.g., elliptical) that maintain dominant modes of transmission and polarization. The walls of slotted array waveguides 115 are selected to withstand the pressure of chamber 110. In one implementation, the walls of slotted array waveguides 115 may have a thickness between about ¼ inch and ½ inch to withstand the 150 pounds per square inch pressure of chamber 110.

Waveguide bends 119 may be implemented with a design similar to slotted array waveguides 115. Moreover, waveguide bends 119 may include slots. To provide a transition from a flange to a slotted array waveguide, each of waveguide bends 119*a-n* may have a bend, such as a 90 degree H-plane bend, although other types of bends may be used depending on the circumstances. The use of waveguide bends 119*a-n* coupled to slotted array waveguides 115 facilitates improved positioning of slots 117 with respect to the material being heated, such as wood product 120. Moreover, waveguide bends 119 facilitate using a plurality of slotted array waveguides, which may allow positioning more slotted array waveguides closer to the material being heated. Although waveguide bend 119*a* and slotted array waveguide 115 are depicted as two separate components, waveguide bend 119 a and slotted array waveguide 115 may be the same component formed from a single waveguide.

Each of slotted array waveguides 115*a-n* may be implemented as a rectangular $TE_{10}$ mode waveguide, with about a 72 inch length, inner rectangular dimensions of about 4.875 inches by 9.75 inches, and outer rectangular dimensions of about 6.875 inches by 10.75 inches, although other modes and sizes may be used. In one implementation, each of slotted array waveguides 115*a-n* may be selected to propagate microwave energy and, in particular, to propagate a wavelength of about 328 millimeters (λ=0.328 meters), which corresponds to about 915 Megahertz, although energy at other wavelengths may be used. Moreover, slotted array waveguides 115 may be implemented with commercially available waveguide material, such as standard sizes WR (waveguide, rectangle) 975. Alternatively, slotted array waveguides 115 may be specially fabricated to satisfy the following equations:

$$(\lambda_c)_{mn} = \frac{2}{\sqrt{\frac{m^2}{a} + \frac{n^2}{b}}}. \quad \text{Equation 1}$$

$$(f_c)_{mn} = \frac{1}{2\pi\sqrt{\mu\varepsilon}}\sqrt{\left(\frac{m\pi}{a}\right)^2 + \left(\frac{n\pi}{b}\right)^2}. \quad \text{Equation 2}$$

where a represents the inside width of the waveguide, b represents the inside height of the waveguide, m represents the number of ½-wavelength variations of fields in the a direction, n represents the number of ½-wavelength variations of fields in the b direction, ∈ represents the permittivity of the waveguide, and μ represents the permeability of the waveguide.

When $TE_{10}$ mode waveguide is used, Equations 1 and 2 may reduce to the following equations:

$$(\lambda_c) = 2a, \quad \text{Equation 3}$$

$$(f)_c = \frac{c}{2a}, \quad \text{Equation 4}$$

where c represents the speed of light $$\left(c = \frac{1}{\sqrt{\mu\varepsilon}}\right)$$

in air. As noted above, waveguide bends 119 may have a similar design as slotted array waveguides 115.

Referring to waveguide bend 119*a* and slotted array waveguide 115*a*, the first slot 117*a* may be positioned about ½ wavelength (λ) from the end wall of waveguide bend 119*a*, where the wavelength (λ) is the operating wavelength of slotted array waveguides 115. The next slot is positioned about ½ wavelength from slot 117*a*. The remaining slots are each positioned at about ½ wavelength intervals along the longitudinal axis of waveguide 115*a*. Although ½ wavelength intervals are described, slots may be spaced at any integer multiple of the ½ wavelength. The slot arrangement of waveguide bend 119*b-n* and slotted array waveguides 115*b-n* may be similar to waveguide bend 119*a* and slotted array waveguide 115*a*. Each of the slots may be angled between 0 degrees and 90 degrees. For example, slot 117*a* may each be angled at 10 degrees from the longitudinal axis of slotted array waveguide 115*a*.

Waveguide bends 119*a-n* and slotted array waveguides 115-*n* may each be pressurized and filled with a gas, such as nitrogen. Moreover, slotted array waveguides 115*a-n* may each be terminated at one end with a waveguide short-circuit or terminated with a waveguide dummy-load circuit, while the other end may be coupled to one of the corresponding waveguide bends 119*a-n*. The slots 117 may be hermetically sealed with a window, described below with respect to FIGS. 4A and 4B. The windows cover slots 117 to serve as a physical barrier, keeping out contaminants while allowing the transmission of electromagnetic energy. If a chemical, such as an acetic anhydride, contaminates the interior of a slotted array waveguide or launcher, their electromagnetic properties may break down, such that the slotted array waveguide may no longer be able to serve as a heater.

Although slotted array waveguides 115 are described above as pressurized and filled with nitrogen, in some applications, such pressurization and nitrogen fill may not be necessary. For example, when slotted array waveguides 115 are used to only dry a material, such as wood product 120, pressurization of slotted array waveguides 115 (and chamber 110) may not be necessary. Moreover, when slotted array waveguides 115 are used in unpressurized environments, slots 117 may not be covered with windows.

Waveguide bends 119 and slotted array waveguides 115 provide near-field heating of wood product 120. To facilitate near-field heating, waveguide bends 119 and slotted array waveguides 115 are placed close to the surface of a material, such as wood product 120. Specifically, the material should be placed in the near-field of a launcher (e.g., slotted array waveguide 115*a* and waveguide bend 119*a*). By using the near-field to heat wood product 120, heating may be less affected by variations in the dielectric properties of wood product 120. As such, the use of waveguide bends 119 and slotted array waveguides 115 as near-field heating mechanisms may provide more even heating of the material, such as wood product 120.

Flanges 114*a-n* may each couple waveguide bend 119*a-n* to the wall of chamber 110 and to coupling waveguides 137*a-n*. Flanges 114 may also include a window to serve as a barrier between the flange and the launcher. A window similar in design to the window described below with respect to FIGS. 4A and 4B may be used as the window at flanges 114.

Coupling waveguides 137*a-n* may be implemented as a waveguide that couples microwave source 135 to slotted array waveguides 115 and waveguide bends 119*a-n* through flanges 114*a-n* and chamber 110. Coupling waveguides 137*a-n* may have a design similar to slotted array waveguide 115.

Microwave source 135 generates energy in the microwave spectrum. For example, if a bundle of wood products 120, such as a bundle of wood planks, is chemically processed in chamber 110, microwave source 135 may be configured to provide 6 kilowatts of power at 2.45 Gigahertz (a free space wavelength of about 122 millimeters) to waveguide bends 119 and slotted array waveguides 115, although other powers and frequencies (wavelengths) may be used. The frequency of source 135 may be scaled to the type and size of the material being heated. For example, when the cross-section of the wood products increases, the frequency of the source 135 may be decreased since lower frequencies may be less absorptive in a wood medium. For example, when an 8½ foot diameter by 63 foot length chamber (sized to accommodate a 4 foot by 4 foot by 60 foot bundle of wood) is used, source 135 may provide an output frequency of 915 Megahertz, although other appropriate frequencies may be used based on the circumstances, such as the material being heated, wood cross section size, and spectrum allocations.

Although microwave source 135 is depicted in FIG. 1 as a single microwave source, microwave source 135 may be implemented as a plurality of microwave sources. For example, a plurality of microwave sources may each couple to one of coupling waveguides 137*a-n*.

Controller 130 may be implemented with a processor, such as a computer, to control microwave source 135. Controller 130 may control the amount of power generated by microwave source 135, the frequency of microwave source 135, and/or the amount of time microwave source 135 is allowed to generate power to slotted array waveguide 115. For example, controller 130 may control the filling of chamber 110 with chemicals, such as acetic anhydride, for treating wood product 120, the subsequent heating of wood product 120 and acetic anhydride, the draining of any remaining acetic anhydride not impregnated into wood product 120, the drying of wood product 120, and the signaling when acetylation is complete.

Controller 130 may also include control mechanisms that respond to temperature and pressure inside chamber 110. For example, when a thermocouple or pressure transducer is placed inside chamber 110, controller 130 may respond to temperature and/or pressure measurements and then adjust the operation of microwave source 135 based on the measurements. Moreover, controller 130 may receive temperature information from sensors placed within the wood. The temperature information may provide feedback to allow control of microwave source 135 during heating and/or drying. Controller 130 may also be responsive to a leak sensor coupled to slotted array waveguide 115. The leak sensor detects leaks from slots 117, which are sealed to avoid contamination from chemicals in chamber 110. When a leak is detected, controller 135 may alert that there is a leak and then initiate termination of heating by waveguide 115.

Controller 130 may also control pressurization module 125. Pressurization module 125 may control the pressure of chamber 110 based on measurements from a pressure transducer in chamber 110. For example, pressurization module 125 may increase or decrease pressure in chamber 110 to facilitate a chemical process, such as acetylation. Controller 130 may also control other operations related to the acetylation process. Although system 100 of FIG. 1 depicts pressurization module 125, in some environments, pressurization module 125 may not be used.

Figure 2A:
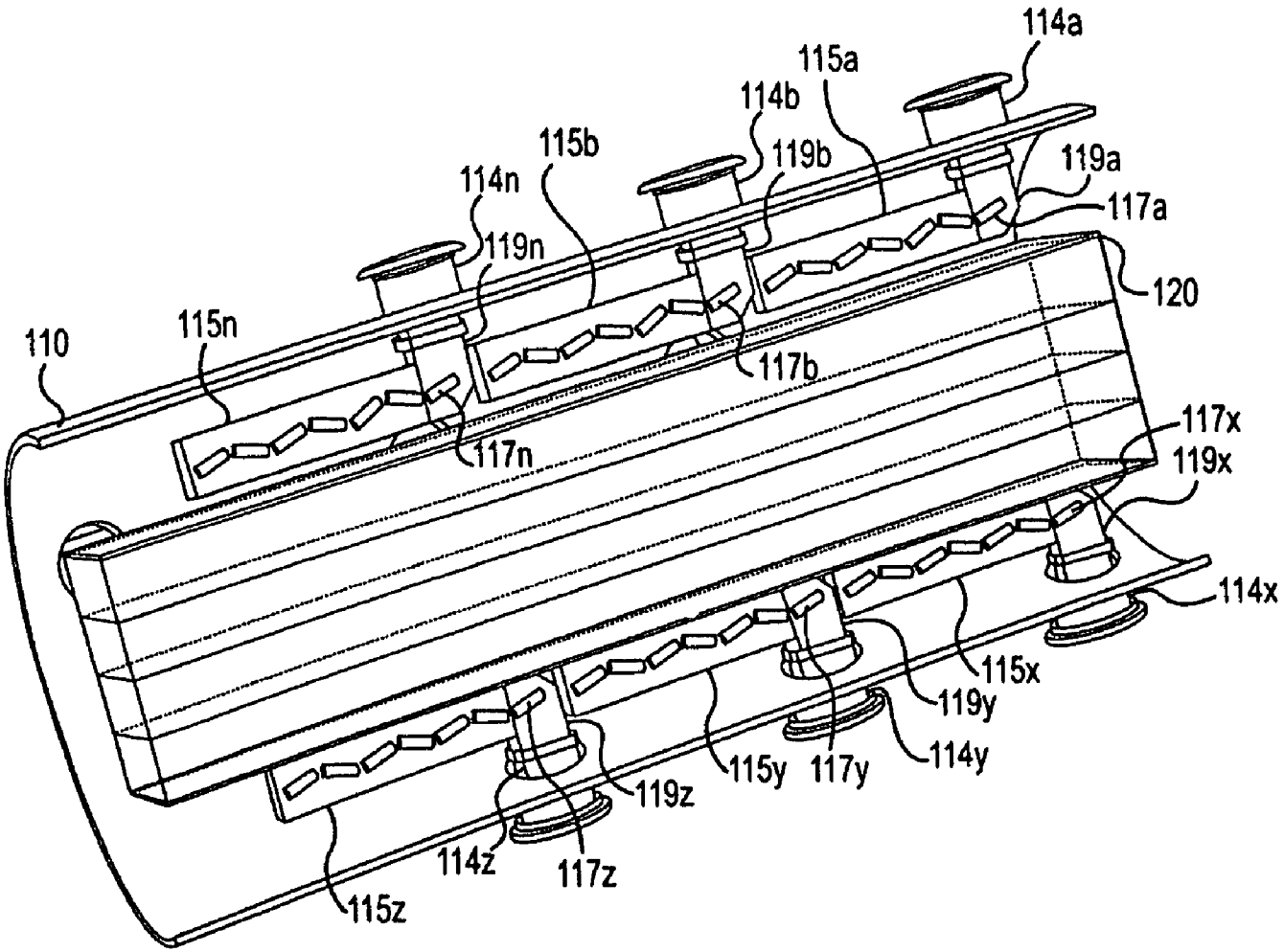
FIG. 2A is a cross section of an example of a microwave reactor having slotted array waveguides coupled to waveguide bends consistent with certain aspects related to the present invention.

FIG. 2A depicts a cross section of an exemplary chamber 110 including a plurality of slotted array waveguides 115*a-z* coupled to corresponding waveguide bends 119*a-z*, which are further coupled to flanges 114*a-z*. FIG. 2A depicts the cross section of wood products 120 as a bundle of wood products. Slotted array waveguides 119*a-z* coupled to corresponding waveguide bends 115*a-z*, which are collectively referred to as launchers 115/119, allow improved placement of the slots with respect to the material being heated. For example, launchers 115/119 may be positioned closer to the surface of wood product 120. FIG. 2A depicts launchers 115/119 on two, opposite sides of wood product 120. In one embodiment, the frequency of launchers 115/119 is lowered from 2.45 Gigahertz to 915 Megahertz. By using a lower frequency, such as 915 Megahertz, the heat penetration through large cross sections of wood is improved—thus allowing more wood to be heated within chamber 110. Furthermore, with improved heat penetration through the material being heated, the fill factor (i.e., the volume of the material being heated in chamber 110 divided by the volume of the chamber 110) of chamber 110 is increased.

Figure 2B:
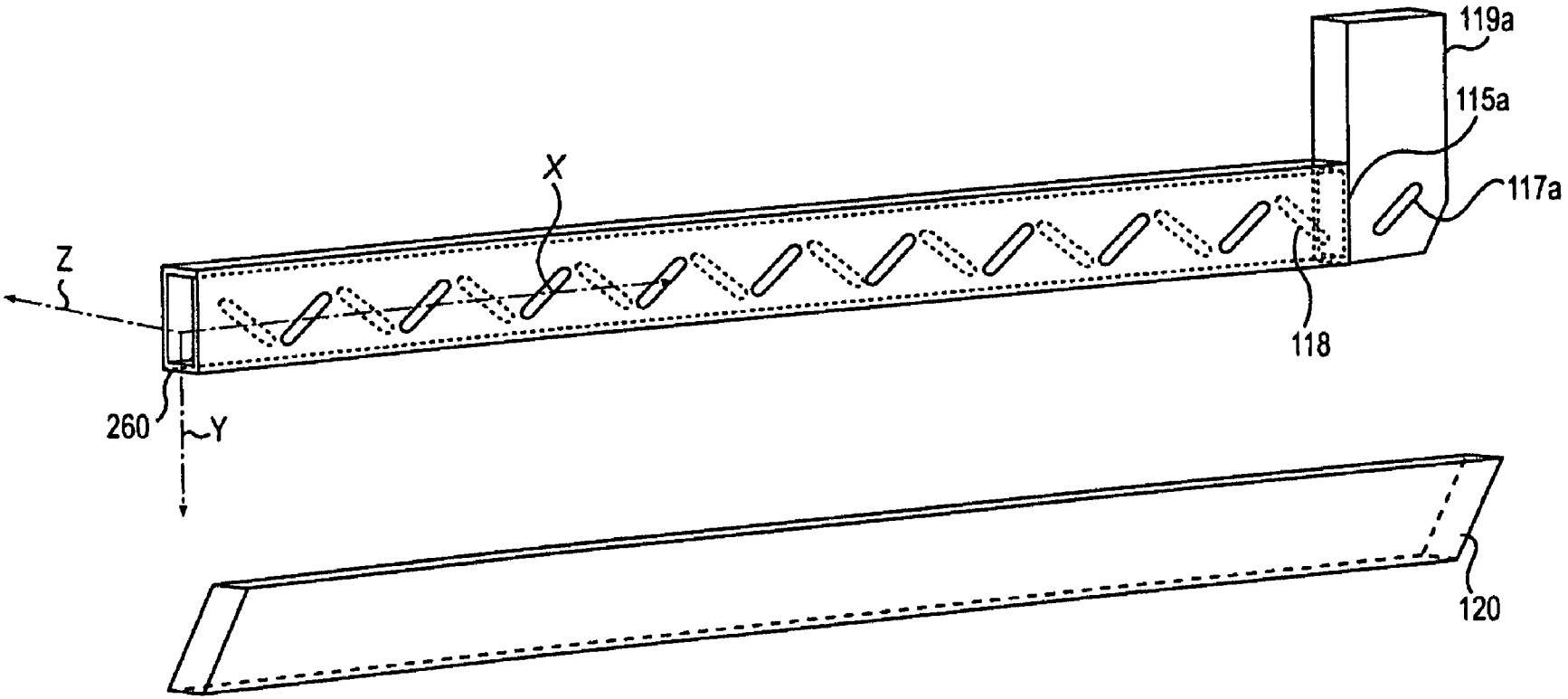
FIG. 2B illustrates a slotted array waveguide coupled to a waveguide bend consistent with certain aspects related to the present invention.

FIG. 2B is another view of a launcher 115*a*/119*a* comprising waveguide bend 119*a* and slotted array waveguide 115*a*. Slots 117 are depicted on one side of launcher 115*a*/119*a*, while the opposite side of launcher 115*a*/119*a* includes slots 118. When slots are used on both sides, the longitudinal spacing between any two slots may be about ½ wavelength (or integer multiples thereof). For example, the first slot is slot 117*a*, which is positioned at ½ wavelength from the end of launcher 115*a*/119*a*. The second slot 118 may be located on the opposite side of launcher 115*a*/119*a* and located about ½ wavelength from slot 117*a*. The third slot may be located about ½ wavelength from slot 118, and on the opposite side of slot 118. Although FIG. 2B depicts an alternating pattern of slots, a variety of arrangements of slots may be used to provide heating of wood product 120, depending of the specific application. Moreover, the angles used for each of slots 117 and 118 may be the same or different.

Slots 117*a* and 118 are slanted at an angle with respect to the longitudinal axis. The angle determines how much energy is transferred from launcher 115*a*/119*a* to the material being heated, such as wood products 120*a-c*. For example, a slot at an angle of zero degrees may result in no energy transfer, while an angle between about 50 degrees and about 60 degrees may result in 100% energy transfer. As noted above, the slots may be placed at about ½ wavelength intervals. The angle and placement of slots 117 may be precisely determined using numerical modeling techniques provided by electromagnetic-field simulation and design software, such as HFSS™ (commercially available from Ansoft, Corporation, Pittsburgh, Pa.). The amount of energy for each slot may be approximated based on the following equation:

$$\frac{100\%}{n}, \qquad \text{Equation 5}$$

where n is the number of slots. For example, if launcher 115*a*/119*a* has five slots, the amount of energy at each slot would be 20%, while the angle to achieve the 20% would be determined using numerical modeling techniques. Although the previous example uses an even distribution of energy among slots, other energy distribution arrangements may be used.

Although the above describes adjusting the angle of a slot to change the amount of energy transmitted by a slot, the interval spacing between slots may also be varied to change the amount of energy transmitted by a slot. Moreover, FIG. 2B depicts slots 117 and 118 positioned on a surface of launcher 115*a*/119*a* which is not directly facing wood products 120; such slot placement may avoid hot spots and overheating of wood product 120 when compared to a slot placement directly facing wood product 120. For example, placing slots at launcher surface 260, which directly faces wood product 120, may cause hot spots and overheating of wood product 120.

Each of the slots may include a window. The window allows electromagnetic energy to be transmitted by a slot. The window also serves as a physical barrier and seals the slot to prevent contaminants from entering a launcher. For example, in one embodiment, the window may be formed using a piece of ceramic material. The ceramic material is virtually electromagnetically transparent to microwave energy—thus allowing the energy to be transmitted from slots 117 and 118 to the material being heated. The ceramic material also serves as a barrier preventing contaminants from entering the launchers. A window having similar design may also be used at the junctions of flanges 114 and the waveguide guide bends.

The microwave energy transmitted by slots 117 and 118 through the windows of launchers facilitate near-field heating of a material, such as wood product 120. The spacing of the slots at about ½ wavelength intervals along the length of the waveguide may provide uniform heating of the wood product along the entire longitudinal length (e.g., axis X at FIG. 2B) of the waveguide. The launchers may be positioned about ½ inch above the material, such as wood product 120, and may run along the length of wood product 120. In some implementations, the ½ wavelength interval between slots may be adjusted to about plus or minus 0.1% of a wavelength.

Figure 3A:
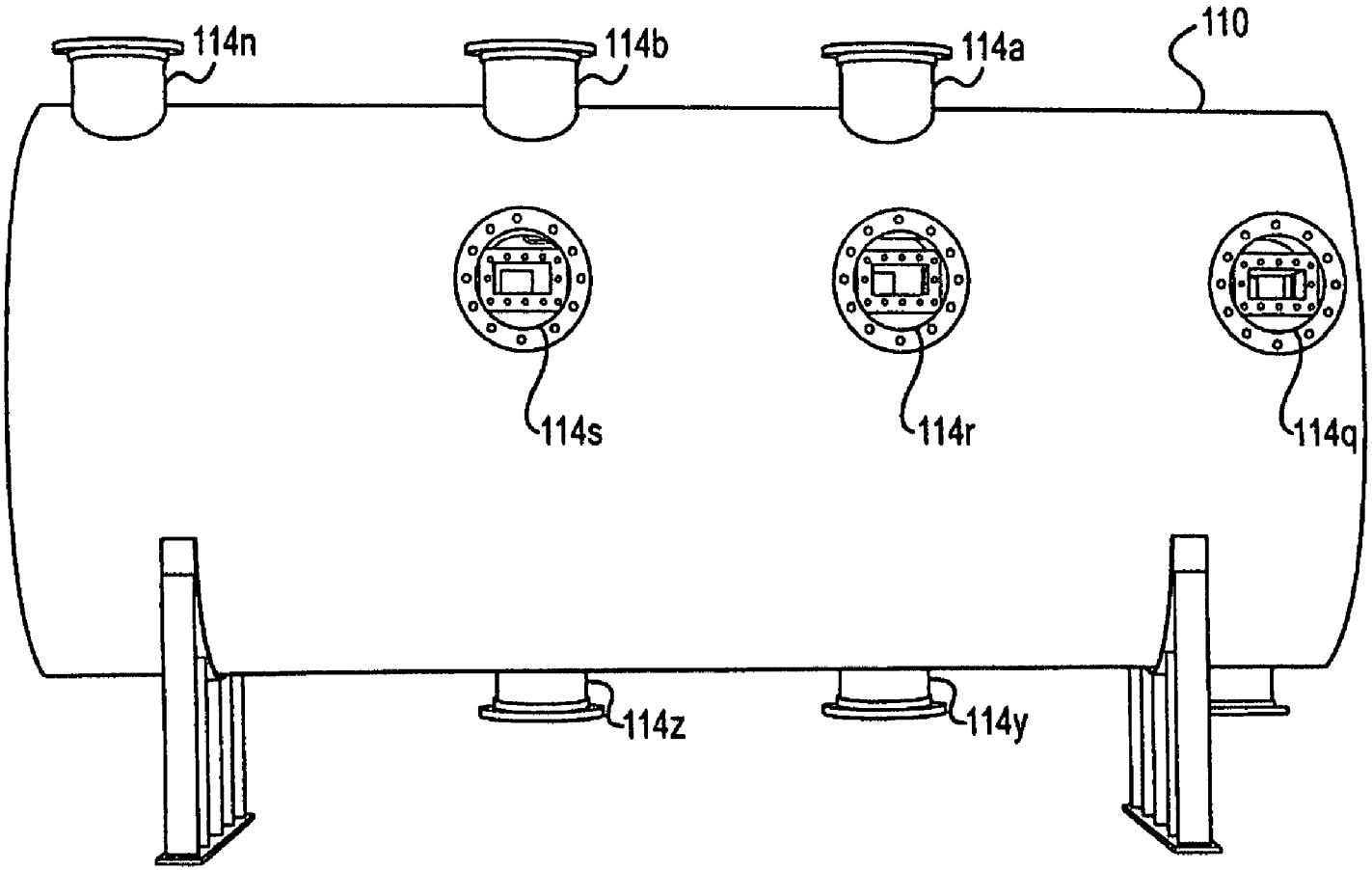
FIG. 3A is a perspective view of a microwave reactor having slotted array waveguides coupled to waveguide bends consistent with certain aspects related to the present invention.
Figure 3B:
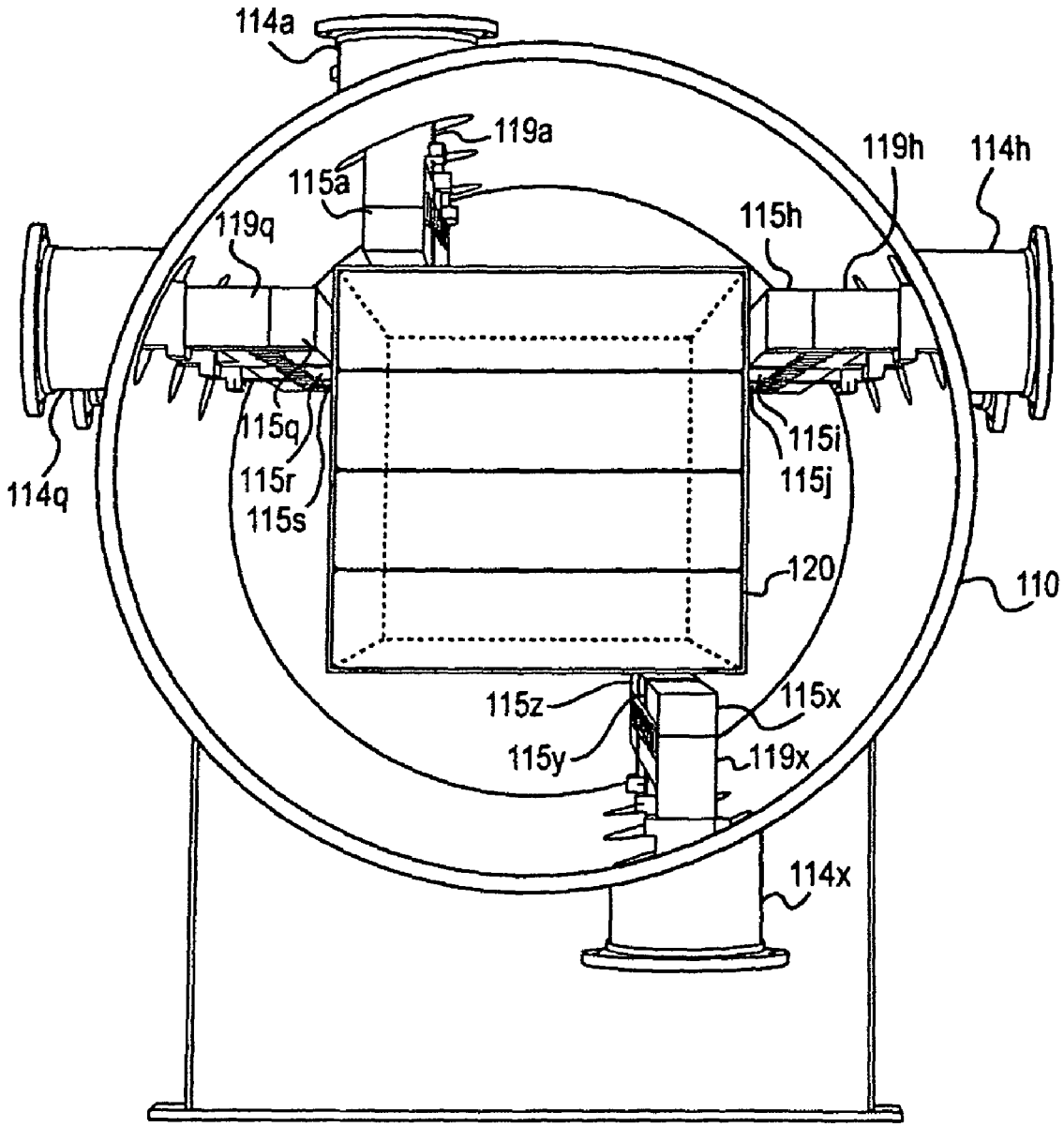
FIG. 3B is a cross section view of the microwave reactor of FIG. 3A.

FIGS. 3A and 3B respectively depict perspective and cross section views of exemplary microwave chamber 110. In addition to slotted array waveguides 115*a-n* and 115*x-z*, which were depicted in FIG. 2A, FIG. 3B shows additional slotted array waveguides 115*h-j* and 115*q-s*. Slotted array waveguides 115*h-j* and slotted array waveguides 115*q-s* and their corresponding waveguide bends are implemented in a manner similar to slotted array waveguide 115*a* and waveguide bend 119*a*, described above. Chamber 110 includes a plurality of launchers around the periphery of the material being heated, which in this example is wood products 120. The additional launchers on all four sides of wood products 120 may provide more even heating of the wood.

Figure 4A:
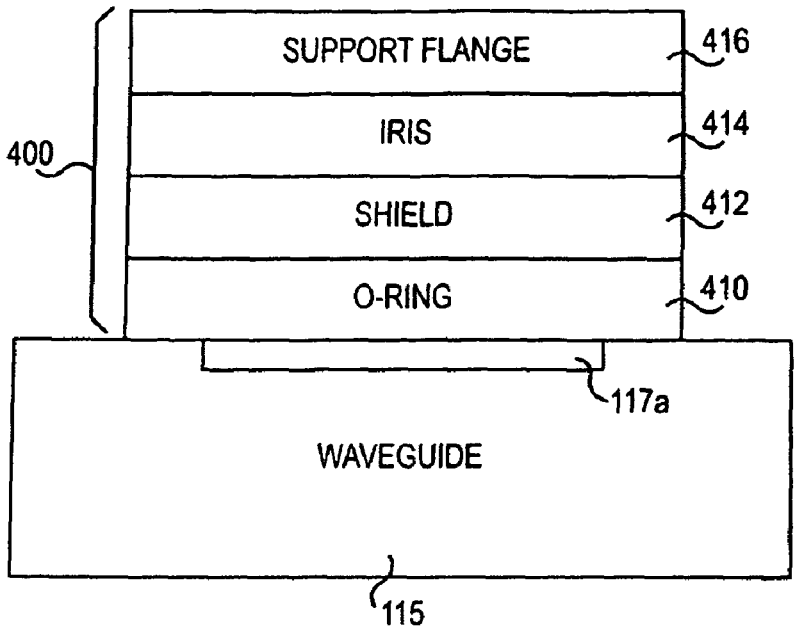
FIG. 4A is a side-view of a window assembly for the slots of the slotted array waveguide consistent with certain aspects related to the present invention.

FIG. 4A depicts an example window 400 used at slots 117 and 118. Referring to FIG. 4*a*, window 400 includes an O-ring 410, a shield 412, an iris 414, and a support flange 416.

O-ring 410 may be implemented using rubber, plastic, or any other appropriate material that can provide a seal. For example, a perfluoroelastomers, such as Kalrez™, Chemraz™, and Simriz™, may be used as the material for O-ring 410. O-ring 410 may provide a hermetic seal between window 400 and a waveguide (or launcher). The O-ring is sized larger than the opening of a slot, and placed on top of a launcher, without blocking the opening of the slot. For example, a channel may be cut in slotted array waveguide 115*a* to accommodate O-ring 410.

Shield 412 is a piece of material sized to cover one of the slots, such as slot 117*a*. Shield 412 has electromagnetic properties that allow transmission of electromagnetic energy through shield 412 with little (if any) loss. Shield 412 also prevents contaminants from traversing the window and entering a launcher. Shield 412 may also be strong enough to withstand the pressures used in chamber 110 and a launcher. In one implementation, a ceramic material, such as aluminum oxide, magnesium oxide, silicon nitride, aluminum nitride, and boron nitride, is used as shield 412. Shield 412 may be sized at least as large as the opening of the slot. In one embodiment, shield 412 may be captured within a receptacle to accommodate screws from support flange 416.

Iris 414 provides compensation for the impedance mismatch associated with shield 412. Specifically, shield 412 may cause an impedance mismatch between the gas of slot 117*a* and ceramic shield 412. This impedance mismatch has similar electrical properties to a capacitor. Iris 414 has similar electrical properties to an inductor to compensate for the capacitive effects of the impedance mismatch. The combination of shield 412 and iris 414 effectively provide a pass band filter that compensates for the impedance mismatch at the frequency associated with slotted array waveguide 115. These capacitive and inductive effects can be modeled using software, such as HFSS™ (commercially available from Ansoft Corporation, Pittsburgh, Pa.). In one embodiment, iris 414 is implemented as a metallic device with an opening similar to slot 117*a*, although the specific dimensions of the opening of iris 414 would be determined using software, such as HFSS™, based on the circumstances, such as frequency of operation, the capacitive and inductive effects, and the like.

Support flange 416 couples iris 414, shield 412, and O-ring 410 to a launcher. For example, flange 416 may capture the components 410-416 to launcher 115*a*/119*a* using a variety of mechanisms, such as screws. The screws go through holes to support flange 416, iris 414, shield 412 (or its receptacle), and launcher 115*a*/119*a*, although other mechanisms to capture the components 410-416 to waveguide 115*a* may be used.

Figure 4B:
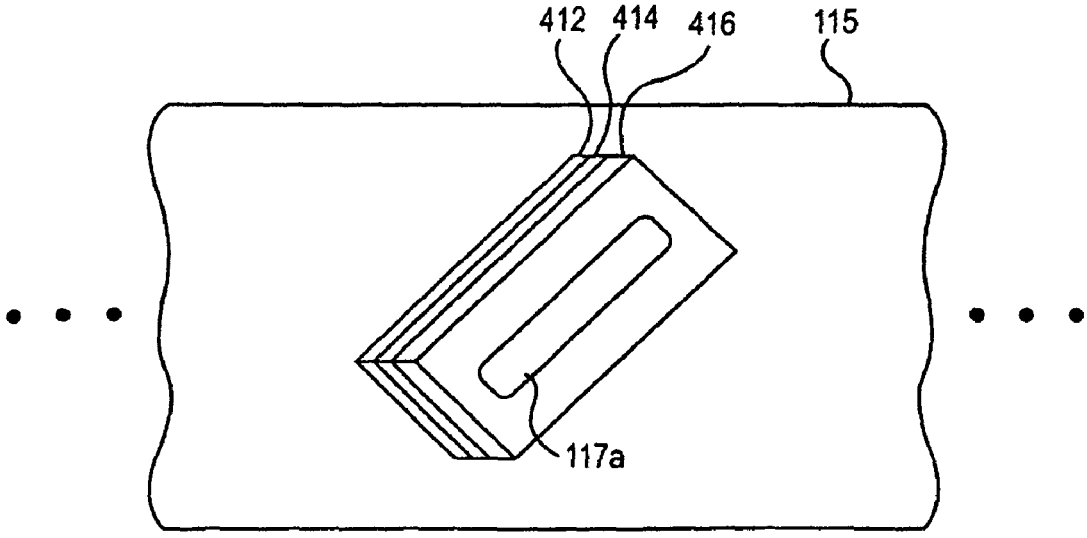
FIG. 4B is another view of the window assembly consistent with certain aspects related to the present invention.

FIG. 4B depicts another view of window 400 of FIG. 4A. A window similar in design to window 400 may also be used at flange 114. In particular, a window may be used to cap the end of a launcher before being coupled to chamber 110.

As described above, microwave energy from launchers (i.e., slotted array waveguides 115 and waveguide bends 119) may be used as a source of heat. Moreover, in some embodiments, the launchers may be used as a source of heat during a chemical process, such as the modification of a wood product by means of acetic anhydride.

The systems herein may be embodied in various forms. Although the above description describes the acetylation of wood products, the systems described herein may be used in other chemical processes and with other materials. Moreover, the systems described herein may be used to provide heat without an associated chemical process, such as acetylation. For example, the system may provide heat to dry a material, or to heat-treat a material, such as anneal, sinter, or melt. In this example, pressurized chamber 110 may not be needed since acetylation of wood is not being performed.

What is claimed is:

1. An apparatus for heating a wood product in a chamber, comprising: a launcher, wherein the launcher comprises: a waveguide bend and a waveguide, the waveguide having a rectangular cross section and a plurality of slots along the longitudinal axis of the waveguide, the slots being disposed on alternating sides of the waveguide and slanted at an angle with respect to the longitudinal axis and spaced at intervals with respect to the longitudinal axis; and a plurality of windows covering the slots, the windows serving as a physical barrier and allowing electromagnetic energy to be transferred from the launcher to the wood product.

2. The apparatus of claim 1, wherein the slots disposed on one side of the waveguide are slanted at an angle with respect to the longitudinal axis that is different from the angle at which the slots disposed on the opposite side of the wavequide are slanted with respect to the longitudinal axis.

3. The apparatus of claim 1, wherein the waveguide bend is an H-plane bend.

4. The apparatus of claim 1, wherein the angle of the slot is between about 5 degrees and about 30 degrees with respect to the longitudinal axis.

5. The apparatus of claim 1 wherein the slots are arranged along a surface of the launcher not directly facing the wood product.

6. The apparatus of claim 1, wherein the windows comprise a shield formed of material comprising aluminum oxide.

7. The apparatus of claim 1, wherein: the windows comprise a shield coupled to an iris; and the iris includes an opening configured to compensate for a capacitive effect of the shield.

8. The apparatus of claim 1, wherein: the windows comprise an assembly comprising a support flange, an iris, a shield, and an O-ring; and the assembly is coupled to the waveguide.

9. The apparatus of claim 1, comprising a chamber sized to accommodate the wood product and the launcher.

10. The apparatus of claim 9, wherein the chamber comprises a pressurized chamber.

11. The apparatus of claim 1, wherein the launcher comprises a waveguide which transfers electromagnetic energy of a predetermined wavelength.

12. A system for acetylating a wood product comprising: a chamber sized to accommodate the wood product; and a launcher disposed within the chamber, the launcher comprising: a waveguide bend and a waveguide having a rectangular cross section; a plurality of slots along the longitudinal axis of the waveguide, the slots being disposed on alternating sides of the waveguide and slanted at an angle with respect to the longitudinal axis and spaced at an interval along the longitudinal axis; and a plurality of windows covering the slots, the windows serving as a barrier and allowing electromagnetic energy to be transferred from the launcher to the wood product.

13. The system of claim 12, wherein the slots disposed on one side of the waveguide are slanted at an angle with respect to the longitudinal axis that is different from the angle at which the slots disposed on the opposite side of the waveguide are slanted with respect to the longitudinal axis.

14. The system of claim 12, wherein the waveguide bend is an H-plane bend.

15. The system of claim 12, wherein the angle of the slots is between about 5 degrees and about 30 degrees with respect to the longitudinal axis.

16. The system of claim 12, wherein the slots are arranged along a surface of the launcher not directly facing the wood product.

17. The system of claim 12, wherein the window comprises a shield formed of material comprising aluminum oxide.

18. The system of claim 12, wherein: the windows comprise a shield coupled to an iris; and the iris includes an opening configured to compensate for a capacitive effect of the shield.

19. The system of claim 12, wherein the windows comprise an assembly comprising a support flange, an iris, a shield, and an O-ring; and the assembly is coupled to the waveguide.

20. The system of claim 12, wherein the chamber is sized to accommodate the wood product and the launcher.

21. The system of claim 12, further comprising a plurality of launchers arranged on two or more sides of the wood product.

22. The system of claim 12, further comprising a controller for controlling a microwave source to provide energy for heating during an acetylation process.

23. A heating system for a material comprising: a launcher comprising a waveguide bend and a waveguide having a rectangular cross section, a plurality of slots along the longitudinal axis of the waveguide, the slots being disposed on alternating sides of the waveguide and slanted at an angle with respect to the longitudinal axis and spaced at an interval along the longitudinal axis; and a plurality of windows, the windows: covering the slots; serving as a physical barrier; and allowing electromagnetic energy to be transferred from the launcher to the material.

24. A system for heating a material comprising: a plurality of launchers configured within a chamber containing a material to supply electromagnetic energy to the interior of the chamber, wherein: the launchers comprise a waveguide bend and a waveguide having a rectangular cross section; the launchers have one or more slots along the longitudinal axis of the waveguides; the slots are disposed on alternating sides of the waveguide and slanted at an angle with respect to the longitudinal axis and spaced at an interval with respect to the longitudinal axis; and one or more windows covering the slots, the windows serving as a physical barrier and allowing electromagnetic energy to be transferred from the launcher to the material.

* * * * *